US011408136B1

(12) United States Patent
Frantz et al.

(10) Patent No.: US 11,408,136 B1
(45) Date of Patent: Aug. 9, 2022

(54) MACHINE AND METHOD OF RESISTING DEBRIS ACCUMULATION ON MILLING ENCLOSURE OF MACHINE

(71) Applicant: Caterpillar Paving Products Inc., Brooklyn Park, MN (US)

(72) Inventors: Matthew-David S. Frantz, Eden Prairie, MN (US); Derek Peter Nieuwsma, Loretto, MN (US); Nathaniel S. Doy, Maple Grove, MN (US); Dustin William Sondreal, Hanover, MN (US); Jason W. Muir, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/205,226

(22) Filed: Mar. 18, 2021

(51) Int. Cl.

| | |
|---|---|
| ***E01C 23/088*** | (2006.01) |
| ***E01C 23/12*** | (2006.01) |
| ***E01C 23/06*** | (2006.01) |
| ***E01C 21/00*** | (2006.01) |

(52) U.S. Cl.
CPC ..... *E01C 23/088* (2013.01); *E01C 21/00* (2013.01); *E01C 23/065* (2013.01); *E01C 23/127* (2013.01)

(58) Field of Classification Search
CPC . E02F 3/144; E02F 3/248; E02F 3/407; E02F 3/405; E02F 3/8155; E02F 3/9287; E02F 5/103; E02F 5/326; E02F 9/221; B08B 7/02; B08B 7/026; B08B 7/028; E01C 19/2015; E01C 19/2035; E01C 23/088; E01C 23/127; E01C 21/00; E01C 23/065
See application file for complete search history.

(56) References Cited

U.S. PATENT DOCUMENTS

| | | | | |
|---|---|---|---|---|
| 5,378,080 | A | 1/1995 | Dickson | |
| 8,794,867 | B2 | 8/2014 | Snoeck et al. | |
| 2004/0146353 | A1* | 7/2004 | Ley | B05B 1/3046 404/90 |
| 2008/0010775 | A1* | 1/2008 | Tomo | E01H 1/0854 15/340.3 |
| 2013/0087172 | A1* | 4/2013 | Roetsch | E01C 21/00 134/8 |

FOREIGN PATENT DOCUMENTS

| | | | |
|---|---|---|---|
| EP | 0218642 | 10/1989 | |
| EP | 2695994 | 6/2015 | |
| EP | 2578749 | 3/2017 | |
| WO | WO-2011067584 A1 * | 6/2011 | B02C 13/095 |
| WO | 2019115003 | 6/2019 | |

* cited by examiner

*Primary Examiner* — Abby J Flynn
*Assistant Examiner* — Michael A Goodwin
(74) *Attorney, Agent, or Firm* — von Briesen & Roper, s.c.

(57) ABSTRACT

A rotary mixer includes a frame. The rotary mixer also includes a milling enclosure supported by the frame. The milling enclosure includes a side plate. The rotary mixer further includes a rotor disposed within the milling enclosure. The rotary mixer includes at least one vibration device coupled to the milling enclosure. The at least one vibration device is arranged to induce vibrations in at least one component of the milling enclosure for resisting accumulation of debris on the at least one component.

9 Claims, 5 Drawing Sheets

MACHINE AND METHOD OF RESISTING DEBRIS ACCUMULATION ON MILLING ENCLOSURE OF MACHINE

TECHNICAL FIELD

The present disclosure relates to machines, such as milling machines and rotary mixers, and a method of resisting debris accumulation on a milling enclosure of such machines.

BACKGROUND

A machine, such as a milling machine, a rotary mixer, and the like, includes a milling rotor for performing one or more work operations. The milling rotor is disposed within a milling enclosure of the machine. Work operations such as, scarifying, removing, mixing, or reclaiming material, involves movement of the machine on different terrains. Further, while performing the work operations, the milling enclosure typically slides on the terrain on which the work operation is being performed.

In some cases, debris such as rocks, concrete, soil, dirt, and the like, may accumulate within the milling enclosure and its associated components. For example, in rotary mixers and milling machines that include one or more movable side plates, such debris may accumulate on the side plates or gaps that are provided adjacent to the side plates for allowing movement of the side plates. In some cases, such debris accumulation may restrict movement of the side plates and may also cause binding of the side plates, which is not desirable. Furthermore, in rotary mixers that have a movable milling enclosure, such debris accumulation may restrict a movement of the milling enclosure. Such restriction in the movement of the milling enclosure and/or the side plates may reduce productivity at a worksite and may also require frequent cleaning for removal of the debris.

WO Publication Number 2019/115003 describes a self-propelled ground milling machine, in particular a road milling machine, comprising a machine frame borne by driving devices, a drive motor arranged on the machine frame, a maneuvering platform arranged on the machine frame, a milling device driven by the drive motor and having a milling roller box which is open at least to the underside and connected to the machine frame, and a milling roller which is rotatable inside the milling roller box around a horizontal working direction and transverse to a working direction and partially projects to the underside of the milling roller box during milling operation, and comprising a mounting tube and a plurality of milling tools arranged on an outer lateral surface of the mounting tube, wherein a drive train is present which transfers the drive energy generated by the drive motor to the milling roller to drive the rotational movement of the milling roller during milling operation, wherein a vibration damping device is arranged between the machine frame and the complete milling roller in such a manner that vibrations arising on the mounting tube during milling operation are damped against the machine frame, wherein the vibration damping device comprises at least one damping element arranged between the milling roller box and the machine frame.

SUMMARY OF THE DISCLOSURE

In one aspect of the present disclosure, a rotary mixer is provided. The rotary mixer includes a frame. The rotary mixer also includes a milling enclosure supported by the frame. The milling enclosure includes a side plate. The rotary mixer further includes a rotor disposed within the milling enclosure. The rotary mixer includes at least one vibration device coupled to the milling enclosure. The at least one vibration device is arranged to induce vibrations in at least one component of the milling enclosure for resisting accumulation of debris on the at least one component.

In another aspect of the present disclosure, a milling machine is provided. The milling machine includes a frame. The milling machine also includes a milling enclosure supported by the frame. The milling enclosure includes a side plate. The milling machine also includes a rotor disposed within the milling enclosure. The milling machine further includes at least one vibration device coupled to the milling enclosure. The at least one vibration device is arranged to induce vibrations in at least one component of the milling enclosure for resisting accumulation of debris on the at least one component.

In yet another aspect of the present disclosure, a method of resisting debris accumulation on a milling enclosure of a machine is provided. The method includes coupling at least one vibration device to the milling enclosure. The method also includes activating the at least one vibration device to induce vibrations in at least one component of the milling enclosure for resisting accumulation of debris on the at least one component.

Other features and aspects of this disclosure will be apparent from the following description and the accompanying drawings.

DETAILED DESCRIPTION

Wherever possible, the same reference numbers will be used throughout the drawings to refer to the same or the like parts. Wherever possible, corresponding or similar reference numbers will be used throughout the drawings to refer to the same or corresponding parts.

Figure 1:
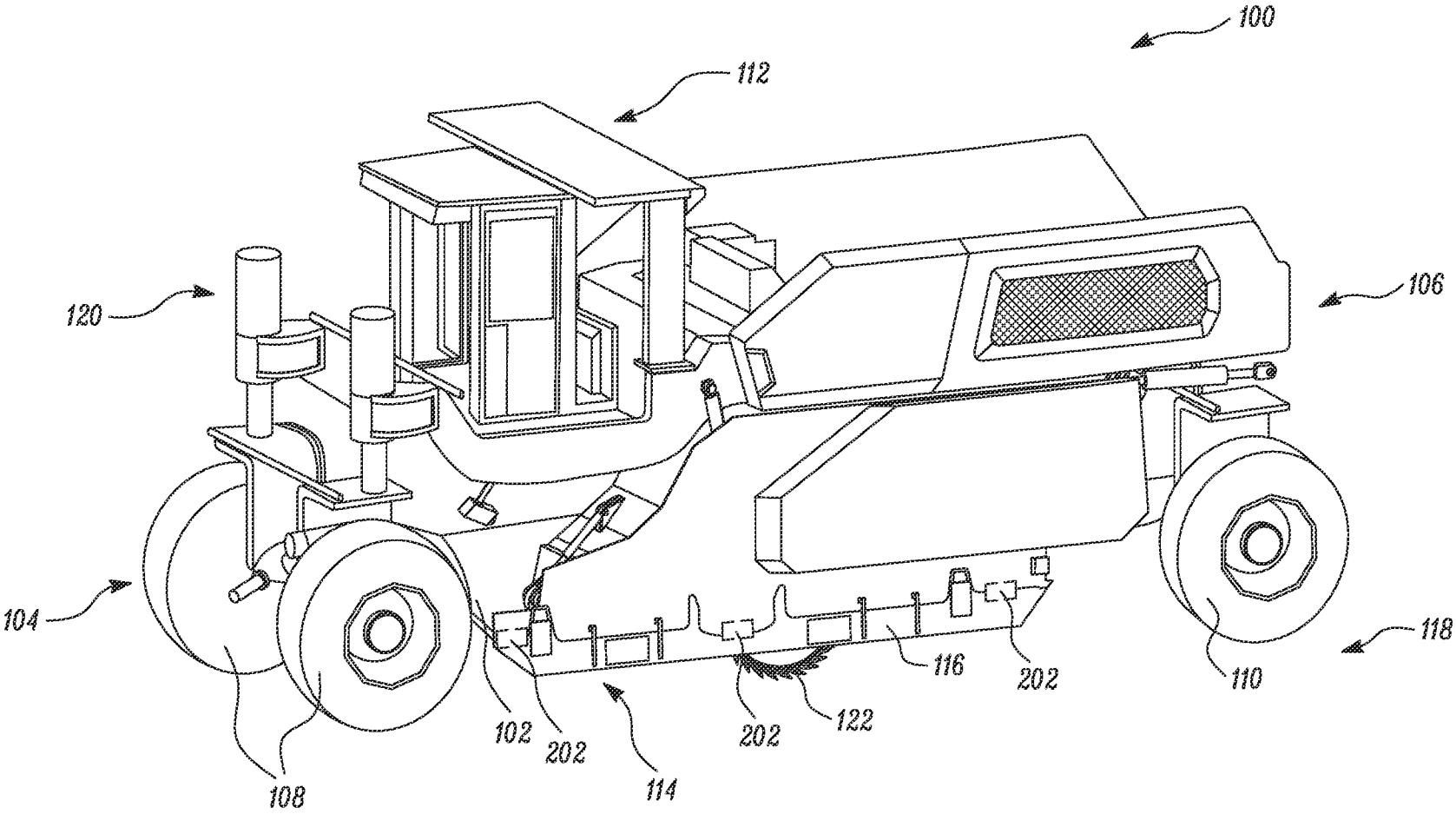
FIG. 1 is a perspective view of a first rotary mixer, in accordance with the present disclosure.

FIG. 1 illustrates an exemplary first rotary mixer 100, hereinafter interchangeably referred to as the rotary mixer 100. Alternatively, the rotary mixer 100 may embody another machine used for scarifying, removing, mixing, or reclaiming material from various terrains. The first rotary mixer 100 includes a frame 102. The frame 102 supports an engine (not shown) to supply operational power to various components of the rotary mixer 100. The engine may include an internal combustion engine.

The rotary mixer 100 has a front end 104 and a rear end 106. The front end 104 of the rotary mixer 100 has a pair of front wheels 108 and the rear end 106 has a pair of rear wheels 110. Alternatively, a pair of tracks may replace the wheels 108, 110. The rotary mixer 100 has an operator platform 112. When the rotary mixer 100 is embodied as a manual or semi-autonomous machine, an operator of the rotary mixer 100 may sit or stand at the operator platform 112 to operate the rotary mixer 100. The operator platform 112 may include a control panel (not shown) to provide inputs for performing one or more work operations.

Further, the rotary mixer 100 includes a milling enclosure 114 supported by the frame 102. The milling enclosure 114 is positioned between the front and rear wheels 108, 110. The milling enclosure 114 includes a side plate 116. More particularly, the milling enclosure 114 is an enclosed space defined by the first side plate 116 disposed on a left side 118 of the rotary mixer 100, a second side plate (not shown) disposed on a right side 120 of the rotary mixer 100, a front wall (not shown), and a rear wall (not shown). In this configuration of the rotary mixer 100, the first side plate 116 and the second side plate are embodied as movable or floating side plates. The first side plate 116 and the second side plate are movable along a vertical direction during work operations, as per application requirements. Further, the front and rear walls of the milling enclosure 114 is fixed with the frame 102 and may move when the rotary mixer 100 is raised or lowered.

The rotary mixer 100 includes a rotor 122 rotatably coupled to the frame 102. The rotor 122 is disposed within the milling enclosure 114. The rotor 122 extends between the first side plate 116 and the second side plate. In one example, the rotor 122 may be embodied as a height adjustable rotor. The rotor 122 includes a number of cutting assemblies (not shown). The cutting assemblies contact the terrain for removing material therefrom. According to a need of the application, the rotor 122 can be lowered so that the rotor 122 contacts and cuts the terrain through force applied by the cutting assemblies on the terrain.

It should be noted that the milling enclosure 114 includes multiple gaps and void spaces. Further, during work operations, debris such as rocks, concrete, soil, or other material from the terrain may accumulate on the components of the milling enclosure 114, which may affect an operation of the rotary mixer 100. More particularly, the debris may accumulate on various components of the milling enclosure 114, such as the first side plate 116, the second side plate, or on mounting components of the first side plate 116 and the second side plate. Further, such debris may also accumulate in between various components of the milling enclosure 114. For example, during a material removal operation, debris may accumulate in gaps that are present adjacent to the first side plate 116 or the second side plate.

Figure 2:
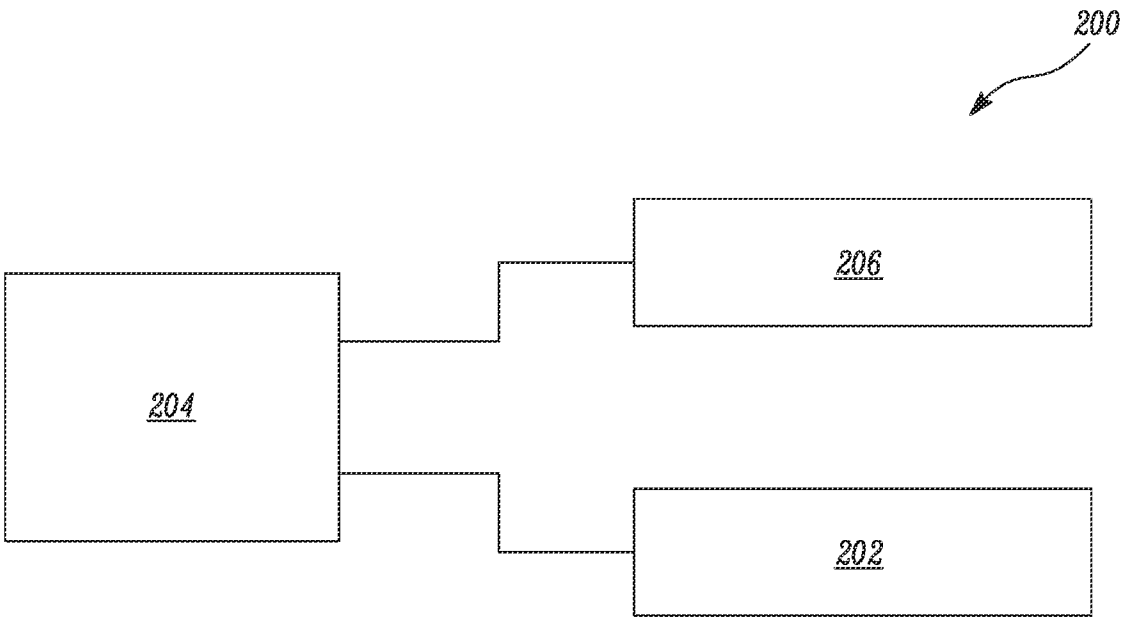
FIG. 2 illustrates a block diagram of a system for resisting accumulation of debris on a milling enclosure of the first rotary mixer of FIG. 1, in accordance with the present disclosure.

Referring to FIG. 2, the present disclosure relates to a system 200 for resisting debris accumulation on the milling enclosure 114 (see FIG. 1) of the rotary mixer 100 (see FIG. 1). The system 200 includes one or more vibration devices 202 and a controller 204. More particularly, the rotary mixer 100 includes the one or more vibration devices 202 coupled to the milling enclosure 114. The one or more vibration devices 202 is arranged to induce vibrations in one or more components of the milling enclosure 114 for resisting accumulation of debris on the one or more components. In the illustrated example, the one or more components of the milling enclosure 114 is the side plate 116 (see FIG. 1) of the milling enclosure 114. More particularly, the side plate 116 includes the movable side plate 116 and the one or more vibration devices 202 is coupled to the side plate 116 of the milling enclosure 114. The first side plate 116 may be hereinafter interchangeably referred to as the side plate 116 or the movable side plate 116. For explanatory purposes, the system 200 will now be explained in relation to resisting debris accumulation on the first side plate 116. However, the system 200 can be used to resist debris accumulation on the second side plate, the front wall, or the rear wall, without any limitations.

Further, the side plate 116 includes three vibration devices 202 (as illustrated in FIG. 1). Alternatively, the side plate 116 may include more than three vibration devices 202 or less than three vibration devices 202. A total number of the vibration devices 202 may vary based on factors such as, but not limited to, a size of the side plate 116. It should be noted that the vibration devices 202 may be coupled to any component of the milling enclosure 114 that is susceptible to debris accumulation. Further, the vibration devices 202 may be mounted at locations on the side plate 116 that creates harmonics which may in turn make the system 200 predictable and controllable.

In some examples, each vibration device 202 may include a pair of eccentric weights. Alternatively, the vibration devices 202 may include any other type of vibration device, without any limitations. In some examples, each vibration device 202 may embody a hydraulically or pneumatically driven actuating piston drive, a motor, or electromagnetic actuators such as solenoids. Further, a design of the vibration devices 202 may be optimized to create vibration forces in specific directions. For example, the vibration devices 202 may be optimized to create vibration forces that causes the side plate 116 to vibrate along a vertical direction. Alternatively, the vibration device 202 may be optimized to create vibration forces that causes the side plate 116 to vibrate along a horizontal direction.

Further, the rotary mixer 100 includes the controller 204 for controlling one or more operating parameters of the one or more vibration devices 202. In some examples, the one or more operating parameters include an activation of the one or more vibration devices 202, the direction of the vibration forces, an amplitude of vibrations, and/or a frequency of vibrations. The controller 204 may activate, deactivate, or tune one or more operating characteristics of the vibration devices 202, as per application requirements.

Further, the rotary mixer 100 includes a sensor 206 communicably coupled to the controller 204. The controller 204 controls the one or more vibration devices 202 based on an input signal received from the sensor 206. More particularly, the controller 204 may control the operating parameters of the vibration devices 202 based on the input signal received from the sensor 206. In some examples, the one or more vibration devices 202 includes the sensor 206. In the illustrated example, the sensor 206 generates the input signal indicative of a relative distance between the one or more vibration devices 202 and the milling enclosure 114. In such examples, the sensor 206 may allow determination of whether the side plate 116 is stuck due to accumulation of debris on the side plate 116. As per the input signals from the sensor 206, the controller 204 may activate the vibration devices 202, increase/decrease the frequency and amplitude of vibrations, and the like.

In some examples, the sensor 206 may embody an accelerometer. Alternatively, the sensor 206 may use any other type of technology such as those used in sonic sensors, laser sensors, hall effect sensors, and the like. Furthermore, the sensor 206 associated with the corresponding vibration device 202 also provides output signals regarding the direction of the vibration forces and the frequency as well as amplitude of vibrations to the controller 204 for providing a closed loop feedback system.

In some examples, the controller 204 may activate the vibration devices 202 when the rotor 122 (see FIG. 1) is in operation. In such examples, the sensor 206 may embody a rotor speed sensor such that an input signal from the rotor speed sensor causes the controller 204 to activate the vibration devices 202. It should be noted that a technique for determining if the side plate 116 is stuck or a position of the sensor 206 mentioned herein are exemplary in nature, and the rotary mixer 100 may include any other sensor 206 or a combination of sensors for controlling the vibration devices 202. Further, the controller 204 may control a hydraulic pressure or an amount of fluid flow associated with a motor that operates the vibration devices 202 for activating, deactivating, or tuning the vibration devices 202.

In another example, the vibration devices 202 may be controlled by manual inputs. For example, the controller 204 may be in communication with an input device (not shown) disposed in the operator platform 112 (see FIG. 1). In such an example, the operator may use the input device for providing an input to the controller 204 in order to activate, deactivate, or tune the vibration devices 202. Alternatively, the input device may be disposed at a remote control station or at any other location at a worksite where the first rotary mixer 100 is operating. In some examples, the input device may be a handheld device present with a personnel/operator in charge of the first rotary mixer 100.

Figure 3:
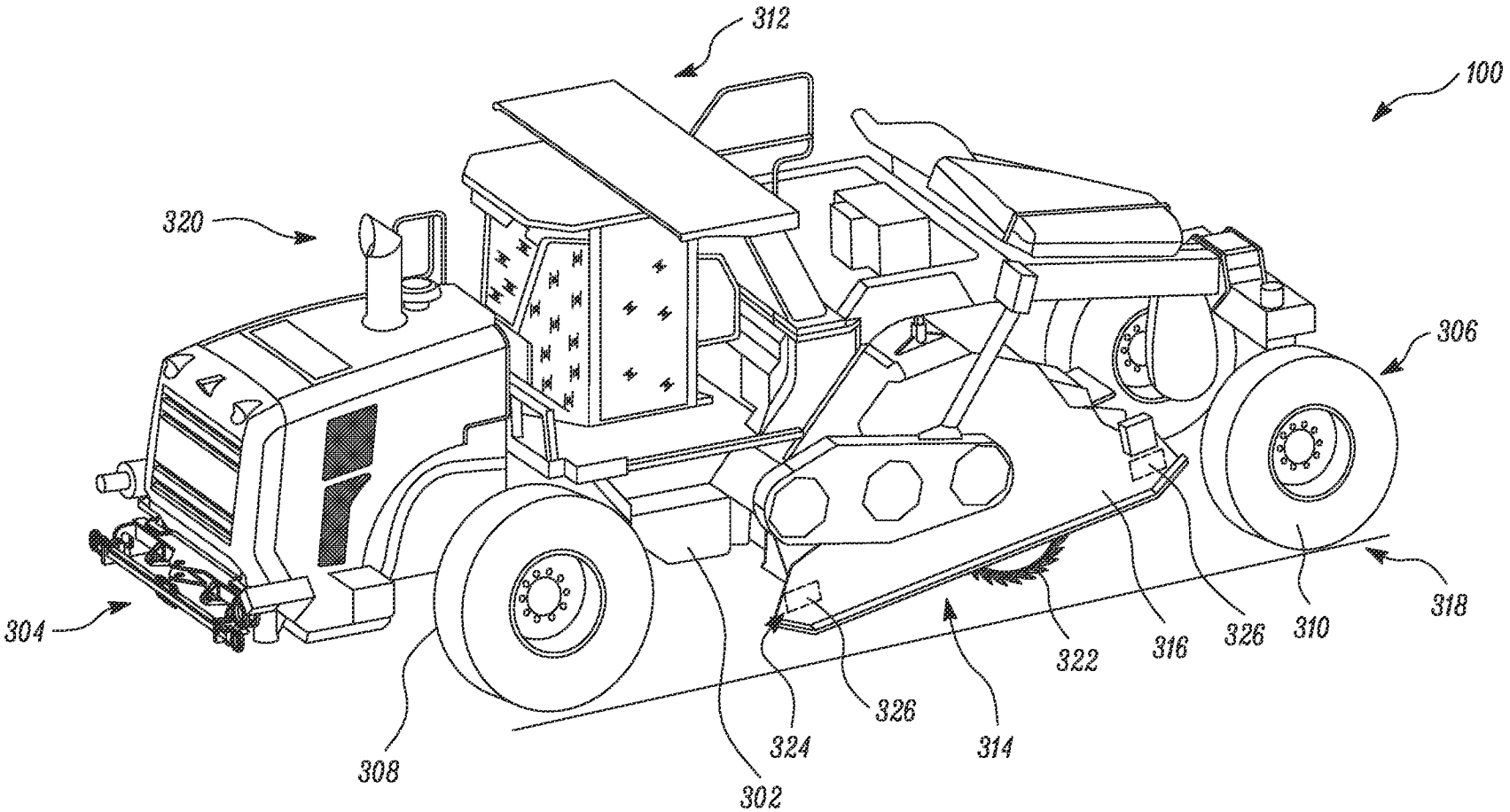
FIG. 3 is a perspective view of a second rotary mixer, in accordance with the present disclosure.

FIG. 3 illustrates an exemplary second rotary mixer 300, hereinafter interchangeably referred to as the rotary mixer 300. The second rotary mixer 300 is substantially similar to the first rotary mixer 100. However, the second rotary mixer 300 includes a floating milling enclosure 314. The milling enclosure 314 is supported by a frame 302. Further, the rotary mixer 300 includes a rotor 322 similar to the rotor 122 of the first rotary mixer 100. The milling enclosure 314 includes a side plate 316. Specifically, the milling enclosure 314 is an enclosed space defined by the first side plate 316 disposed on a left side 318 of the rotary mixer 300, the second side plate (not shown) disposed on a right side 320 of the rotary mixer 300, a front wall, and a rear wall.

Further, the rotary mixer 300 includes a system 324 that is similar to the system 200. The system 324 includes one or more vibration devices 326 and a controller (not shown) similar to the vibration devices 202 and the controller 204 associated with the system 200. The one or more vibration devices 326 is arranged to induce vibrations in one or more components of the milling enclosure 314 for resisting accumulation of debris on the one or more components. In the illustrated example, the one or more components of the milling enclosure 314 is the side plate 316 of the milling enclosure 314. More particularly, the one or more vibration devices 326 may be connected to the side plate 316 of the milling enclosure 314. It should be noted that the vibration devices 326 may be coupled to any component of the milling enclosure 314 that is susceptible to debris accumulation. The first side plate 316 may be hereinafter interchangeably referred to as the side plate 316.

Further, the side plate 316 includes two vibration devices 326. Alternatively, the side plate 316 may include more than two vibration devices or a single vibration device. A total number of the vibration devices 326 may vary based on factors such as, but not limited to, a size of the side plate 316. Alternatively, the one or more vibration devices 326 may be coupled to the second side plate, the front wall, or the rear wall of the milling enclosure 314.

Further, the rotary mixer 300 includes the controller for controlling one or more operating parameters of the one or more vibration devices 326. In some examples, the one or more operating parameters includes an activation of the one or more vibration devices 326, the direction of the vibration forces, an amplitude of vibrations, and/or a frequency of vibrations. The controller may activate, deactivate, or tune one or more operating characteristics of the vibration devices 326, as per application requirements.

Further, the rotary mixer 300 includes a sensor (not shown) communicably coupled to the controller. In some examples, the sensor of the rotary mixer 300 may be similar to the sensor 206 of the rotary mixer 100. The controller controls the one or more vibration devices 326 based on an input signal received from the sensor. More particularly, the controller may control the operating parameters of the vibration devices 326 based on the input signal received from the sensor. In some examples, the one or more vibration devices 326 includes the sensor. In such examples, the sensor may allow to determine if the side plate 116 is stuck due to accumulation of debris on the side plate 116. As per the input signals from the sensor, the controller may activate the vibration devices 326, increase/decrease the frequency and amplitude of vibrations, and the like.

In some examples, the sensor may embody an accelerometer. Alternatively, the sensor may use any other type of technology such as those used in sonic sensors, laser sensors, hall effect sensors, and the like. Furthermore, the sensor associated with the corresponding vibration device 326 also provides output signals regarding the direction of the vibration forces and the frequency as well as amplitude of vibrations to the controller for providing a closed loop feedback system.

Further, in some examples, the sensor may be mounted on the milling enclosure 314 to determine a position of the floating milling enclosure 314 to know if the milling enclosure 314 is stuck due to debris accumulation. In other examples, the controller may activate the vibration devices 326 when the rotor 322 is in operation. In such examples, the sensor may embody a rotor speed sensor such that the input signal from the rotor speed sensor causes the controller to activate the vibration devices 326. It should be noted that a technique for determining if the milling enclosure 314 is stuck or a position of the sensor mentioned herein are exemplary in nature, and the rotary mixer 300 may include any other sensor or a combination of sensors for controlling the vibration devices 326. Further, the controller may control a hydraulic pressure or an amount of fluid flow associated with a motor that operates the vibration devices 326 for activating, deactivating, or tuning the vibration devices 326.

In another example, the vibration devices 326 may be controlled by manual inputs. For example, the controller may be in communication with an input device (not shown) disposed in an operator platform 312 of the second rotary mixer 300. In such an example, the operator may use the input device for providing an input to the controller in order to activate, deactivate, or tune the vibration devices 326. Alternatively, the input device may be disposed at a remote control station or at any other location at a worksite where the second rotary mixer 300 is operating. In some examples, the input device may be a handheld device present with a personnel/operator in charge of the second rotary mixer 300.

Figure 4:
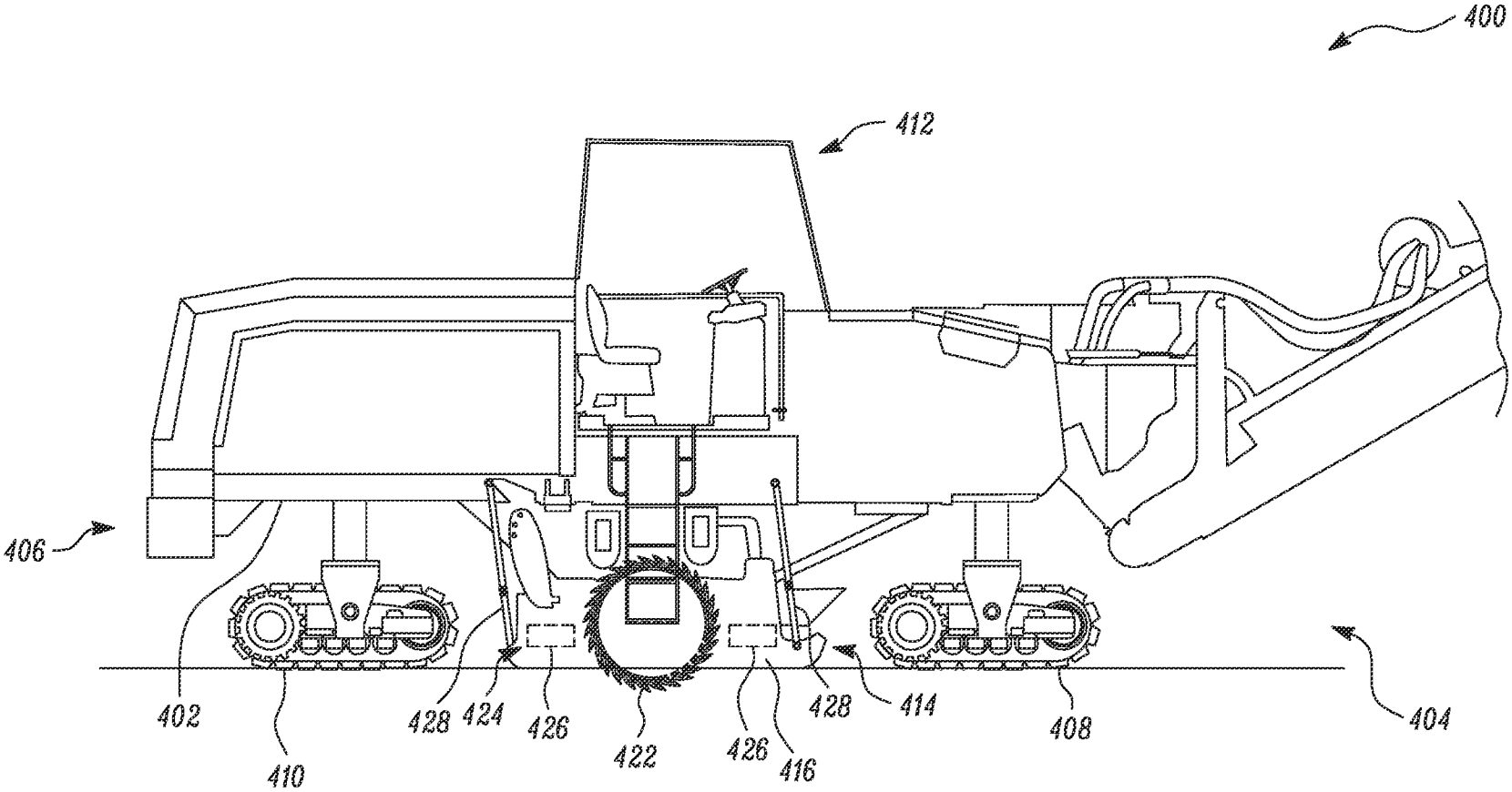
FIG. 4 illustrates aside view of a milling machine, in accordance with the present disclosure.

FIG. 4 illustrates an exemplary milling machine 400. Further, the first rotary mixer 100, the second rotary mixer 300, and the milling machine 400 may be hereinafter collectively referred to as the machine 100, 300, 400. The milling machine 400 may embody a cold planer. The milling machine 400 includes a frame 402. The frame 402 supports an engine (not shown) to supply operational power to various components of the milling machine 400. The engine may include an internal combustion engine. The milling machine 400 has a front end 404 and a rear end 406. The front end 404 of the milling machine 400 has a pair of front tracks 408 and the rear end 406 has a pair of rear tracks 410. Alternatively, the pair of tracks 408, 410 may be replaced by wheels. The milling machine 400 has an operator platform 412. When the milling machine 400 is embodied as a manual or semi-autonomous machine, an operator of the milling machine 400 may sit or stand at the operator platform 412 to operate the milling machine 400. The operator platform 412 may include a control panel (not shown) to provide inputs for performing one or more work operations.

Further, the milling machine 400 includes a milling enclosure 414 supported by the frame 402. The milling enclosure 414 is positioned between the front and rear tracks 408, 410. The milling enclosure 414 is an enclosed space defined by a first side plate 416 disposed on a right side of the milling machine 400, a second side plate (not shown) disposed on a left side of the milling machine 400, a front wall (not shown), and a rear wall (not shown). In this configuration of the milling machine 400, the first side plate 416 and the second side plate are embodied as movable side plates. The first side plate 416 and the second side plate may be moved along a vertical direction during work operations, as per application requirements. The first side plate 416 is movable by actuators 428. The actuators 428 may be hydraulically operated or pneumatically operated. Further, the second side plate is also movable by actuators (not shown).

The milling machine 400 includes a rotor 422 rotatably coupled to the frame 402. The rotor 422 is disposed within the milling enclosure 414. The rotor 422 extends between the first side plate 416 and the second side plate. In one example, the rotor 422 may be embodied as a height adjustable rotor. The rotor 422 includes a number of cutting assemblies (not shown). The cutting assemblies contact with various terrains for removing material therefrom. According to a need of the application, the rotor 422 can be lowered so that the rotor 422 contacts and cuts the terrain through force applied by the cutting assemblies on the terrain.

It should be noted that the milling enclosure 414 includes multiple gaps and void spaces. Further, during work operations, debris such as rocks, concrete, soil, or other material from the terrain may accumulate on the components of the milling enclosure 414, which may affect an operation of the milling machine 400. More particularly, the debris may accumulate on various components of the milling enclosure 414, such as the first side plate 416, the second side plate, or on mounting components of the first side plate 416 and the second side plate.

Accordingly, a system 424 for resisting debris accumulation on the milling enclosure 414 of the milling machine 400 is provided. The system 424 includes one or more vibration devices 426 and a controller. The vibration devices 426 and the controller of the milling machine 400 may be similar to the vibration devices 202 and the controller 204 of the rotary mixer 100. The milling machine 400 includes the one or more vibration devices 426 coupled to the milling enclosure 414. The one or more vibration devices 426 is arranged to induce vibrations in one or more components of the milling enclosure 414 for resisting accumulation of debris on the one or more components. In the illustrated example, the one or more components in embodied as the side plate 416. Specifically, the one or more vibration devices 426 may be connected to the side plate 416 of the milling enclosure 414. The first side plate 416 may be hereinafter interchangeably referred to as the side plate 416 or the movable side plate 416.

For explanatory purposes, the system 424 will now be explained in relation to resisting debris accumulation on the first side plate 416. However, the system 200 can be used to resisting debris accumulation on the second side plate, the front wall, or the rear wall, without any limitations. As illustrated, the side plate 416 includes the movable side plate 416 and the one or more vibration devices 426 is coupled to the side plate 416 of the milling enclosure 414. Further, the side plate 416 includes two vibration devices 426. Alternatively, the side plate 416 may include more than two vibration devices or a single vibration device. A total number of the vibration devices 426 may vary based on factors such as, but not limited to, a size of the side plate 416. It should be noted that the vibration devices 426 may be coupled to any component of the milling enclosure 414 that is susceptible to debris accumulation.

Further, the milling machine 400 includes the controller for controlling one or more operating parameters of the one or more vibration devices 426. In some examples, the one or more operating parameters include an activation of the one or more vibration devices 426, the direction of the vibration forces, an amplitude of vibrations, and/or a frequency of vibrations. The controller may activate, deactivate, or tune one or more operating characteristics of the vibration devices 426, as per application requirements.

Further, the milling machine 400 includes a sensor communicably coupled to the controller. In some examples, the sensor of the milling machine 400 may be similar to the sensor 206 of the rotary mixer 100. The controller controls the one or more vibration devices 426 based on an input signal received from the sensor. More particularly, the controller may control the operating parameters of the vibration devices 426 based on the input signal received from the sensor. In some examples, the one or more vibration devices 426 includes the sensor. In some examples, the sensor generates the input signal indicative of a relative distance between the one or more vibration devices 426 and the milling enclosure 414. In such examples, the sensor may allow to determine if the side plate 416 is stuck due to accumulation of debris on the side plate 416. As per the input signals from the sensor, the controller may activate the vibration devices 426, increase/decrease the frequency and amplitude of vibrations, and the like.

In some examples, the sensor may embody an accelerometer. Alternatively, the sensor may use any other type of technology such as those used in sonic sensors, laser sensors, hall effect sensors, and the like. Furthermore, the sensor associated with the corresponding vibration device 426 also provides output signals regarding the direction of the vibration forces and the frequency as well as amplitude of vibrations to the controller for providing a closed loop feedback system.

Further, the sensor may be associated with the actuators 428 that move the side plate 416. In such examples, the sensor may generate signals corresponding to a position of the actuators 428, a pressure associated with the actuators 428, and the like, to determine if the side plate 416 is operating or the side plate 416 is stuck due to debris accumulation. In some examples, the controller may activate the vibration devices 426 when the rotor 422 is in operation. In such examples, the sensor may embody a rotor speed sensor such that an input signal from the rotor speed sensor causes the controller to activate the vibration devices 426. It should be noted that a technique for determining if the side plate 416 is stuck or a position of the sensor mentioned herein are exemplary in nature, and the milling machine 400 may include any other sensor or a combination of sensors for controlling the vibration devices 426. Further, the controller may control a hydraulic pressure or an amount of fluid flow associated with a motor that operates the vibration devices 426 for activating, deactivating, or tuning the vibration devices 426.

In another example, the vibration devices 426 may be controlled by manual inputs. For example, the controller may be in communication with an input device (not shown) disposed in the operator platform 412. In such an example, the operator may use the input device for providing an input to the controller in order to activate, deactivate, or tune the vibration devices 426. Alternatively, the input device may be disposed at a remote control station or at any other location at a worksite where the milling machine 400 is operating. In some examples, the input device may be a handheld device present with a personnel/operator in charge of the milling machine 400.

The controller 204 and the controller associated with the systems 324, 424 may embody an onboard Electronic Control Module (ECM). The controller 204 and the controller associated with the systems 324, 424 may be embodied as a single microprocessor or multiple microprocessors for receiving signals from various components of the machine. Numerous commercially available microprocessors may be configured to perform the functions of the controller 204 and the controller associated with the systems 324, 424. It should be appreciated that the controller 204 and the controller associated with the systems 324, 424 may embody a machine microprocessor capable of controlling numerous machine functions. A person of ordinary skill in the art will appreciate that the controller may additionally include other components and may also perform other functions not described herein.

INDUSTRIAL APPLICABILITY

The present disclosure relates to usage of the vibration devices 202, 326, 426 for inducing vibrations in one or more components of the milling enclosure 114, 314, 414. The vibration of the components of the milling enclosure 114, 314, 414 may deter accumulation of debris thereon and may also remove the debris accumulated on such components. Further, the vibration devices 202, 326, 426 may be controlled to create vibration in specific directions. For example, when the vibration devices 202, 326, 426 create vibration forces along the vertical direction, the vibration devices 202, 326, 426 may allow improved sliding of the side plates over various terrain, provide compaction of the terrain based on the movement of the side plate 116, 316, 416 over the terrain, and also prevent component wear.

In case of the machines 100, 400 having the movable side plates 116, 416, the vibration devices 202, 426 may prevent debris accumulation on the side plates 116, 416, thereby preventing binding of the side plates 116, 416. As a result, the side plates 116, 416 may be able to float or move freely in the vertical direction in order to cover a space between the milling enclosure 114, 414 and the terrain on which the machines 100, 400 are operating. Further, for the second rotary mixer 300, the vibration devices 326 may be mounted on any component of the milling enclosure 314 and specifically on the first side plate 316 and the second side plate, for reducing a possibility of binding of the milling enclosure 314.

In some examples, the vibration devices 202, 326, 426 may be mounted at locations that are susceptible to debris accumulation. Further, the vibration devices 202, 326, 426 may be mounted at locations that creates harmonics in the system 200, 324, 424 which may in turn make the system 200, 324, 424 predictable and controllable. Moreover, the vibration devices 202, 326, 426 are controllable for providing a closed loop feedback system. The vibration devices 202, 326, 426 may be activated or deactivated, or the frequency or amplitude of the vibration devices 202, 326, 426 may be controlled by such a closed loop feedback system.

Figure 5:
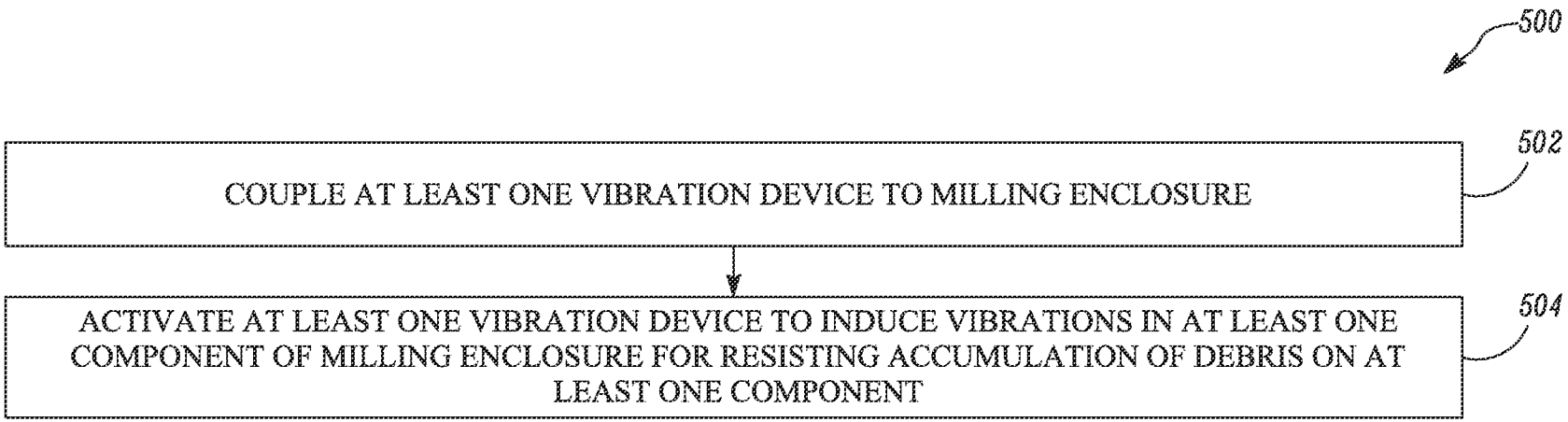
FIG. 5 is a flowchart for a method of resisting debris accumulation on the milling enclosure of the machine.

FIG. 5 illustrates a flowchart for a method 500 of resisting debris accumulation on the milling enclosure 114, 314, 414 of the machine 100, 300, 400. The machine 100, 300, 400 may include the first rotary mixer 100, the second rotary mixer 300, or the milling machine 400. For exemplary purposes, the method 500 will now be explained in relation to the first rotary mixer 100. However, the method 500 is equally applicable to the second rotary mixer 300 and the milling machine 400. At step 502, the one or more vibration devices 202 is coupled to the milling enclosure 114. In an example, the one or more vibration devices 202 is coupled to the movable side plate 116 of the milling enclosure 114.

At step 504, the one or more vibration devices 202 is activated to induce vibrations in the one or more components of the milling enclosure 114 for resisting accumulation of debris on the one or more components of the milling enclosure 114. Further, the controller 204 may control one or more operating parameters of the one or more vibration devices 202. The one or more operating parameters include one or more of the activation of the one or more vibration devices 202, the direction of the vibration forces, the amplitude of vibrations, and the frequency of vibrations. In an example, the controller 204 controls the one or more vibration devices 202 based on the input signal received from the sensor 206. The sensor 206 is communicably coupled to the controller 204. Further, in some examples, the sensor 206 generates the input signal indicative of the relative distance between the one or more vibration devices 202 and the milling enclosure 114.

While aspects of the present disclosure have been particularly shown and described with reference to the embodiments above, it will be understood by those skilled in the art that various additional embodiments may be contemplated by the modification of the disclosed machines, systems, and methods without departing from the spirit and scope of what is disclosed. Such embodiments should be understood to fall within the scope of the present disclosure as determined based upon the claims and any equivalents thereof.

What is claimed is:

1. A rotary mixer comprising:

a frame;

a milling enclosure supported by the frame, the milling enclosure including a side plate;

a rotor disposed within the milling enclosure;

at least one vibration device coupled to the milling enclosure, wherein the at least one vibration device is arranged to induce vibrations in at least one component of the milling enclosure for resisting accumulation of debris on the at least one component;

a controller configured to control one or more operating parameters of the at least one vibration device; and a sensor communicably coupled to the controller, wherein the controller is configured to control the at least one vibration device based on an input signal received from the sensor, wherein the at least one vibration device includes the sensor, wherein the sensor is configured to generate the input signal indicative of a relative distance between the at least one vibration device and the milling enclosure.

2. The rotary mixer of claim 1, wherein the side plate includes a movable side plate and the at least one vibration device is coupled to the side plate of the milling enclosure.

3. The rotary mixer of claim 1, wherein the one or more operating parameters include at least one of an activation of the at least one vibration device, a direction of vibration forces, an amplitude of vibrations, and a frequency of vibrations.

4. A milling machine comprising:

a frame;

a milling enclosure supported by the frame, the milling enclosure including a side plate;

a rotor disposed within the milling enclosure;

at least one vibration device coupled to the milling enclosure, wherein the at least one vibration device is arranged to induce vibrations in at least one component of the milling enclosure for resisting accumulation of debris on the at least one component;

a controller configured to control one or more operating parameters of the at least one vibration device; and a sensor communicably coupled to the controller, wherein the controller is configured to control the at least one vibration device based on an input signal received from the sensor, wherein the at least one vibration device includes the sensor, wherein the sensor is configured to generate the input signal indicative of a relative distance between the at least one vibration device and the milling enclosure.

5. The milling machine of claim 4, wherein the side plate includes a movable side plate and the at least one vibration device is coupled to the side plate of the milling enclosure.

6. The milling machine of claim 4, wherein the one or more operating parameters include at least one of an activation of the at least one vibration device, a direction of vibration forces, an amplitude of vibrations, and a frequency of vibrations.

7. A method of resisting debris accumulation on a milling enclosure of a machine, the method comprising:

coupling at least one vibration device to the milling enclosure;

activating the at least one vibration device to induce vibrations in at least one component of the milling enclosure for resisting accumulation of debris on the at least one component controlling, by a controller, one or more operating parameters of the at least one vibration device;

controlling, by the controller, the at least one vibration device based on an input signal received from a sensor, wherein the sensor is communicably coupled to the controller; and generating, by the sensor, the input signal indicative of a relative distance between the at least one vibration device and the milling enclosure.

8. The method of claim 7 further comprising coupling the at least one vibration device to a movable side plate of the milling enclosure.

9. The method of claim 7, wherein the one or more operating parameters include at least one of an activation of the at least one vibration device, a direction of vibration forces, an amplitude of vibrations, and a frequency of vibrations.

* * * * *